US009879425B2

(12) United States Patent
Lachance

(10) Patent No.: US 9,879,425 B2
(45) Date of Patent: Jan. 30, 2018

(54) DEVICE FOR SUPPORTING ACOUSTICAL CEILINGS

(71) Applicant: Marc Lachance, Canyon County, CA (US)

(72) Inventor: Marc Lachance, Canyon County, CA (US)

( * ) Notice: Subject to any disclaimer, the term of this patent is extended or adjusted under 35 U.S.C. 154(b) by 0 days.

(21) Appl. No.: 15/360,907

(22) Filed: Nov. 23, 2016

(65) Prior Publication Data

US 2017/0167136 A1 Jun. 15, 2017

Related U.S. Application Data

(60) Provisional application No. 62/264,961, filed on Dec. 9, 2015.

(51) Int. Cl.
*E04B 9/18* (2006.01)
*E04B 9/20* (2006.01)

(52) U.S. Cl.
CPC ..... *E04B 9/20* (2013.01); *E04B 9/18* (2013.01); *E04B 9/183* (2013.01)

(58) Field of Classification Search
CPC . E04B 9/006; E04B 9/18; E04B 9/183; E04B 9/20; E04B 9/205; E04B 2009/186
See application file for complete search history.

(56) References Cited

U.S. PATENT DOCUMENTS 3,842,561 A * 10/1974 Wong ..... E04H 9/02 248/354.4
4,819,405 A * 4/1989 Jackson ..... E04C 2/523 52/171.3
6,612,091 B1 * 9/2003 Glover ..... E06B 3/6604 428/34
9,027,208 B1 * 5/2015 Gretz ..... F16G 11/048 24/135 A
2004/0202803 A1 * 10/2004 Hoover ..... E06B 3/6715 428/34
2007/0290113 A1 * 12/2007 Henriques ..... E04B 9/18 248/320

(Continued)

FOREIGN PATENT DOCUMENTS

DE 3049346 A1 * 7/1982 ..... E04B 9/16
JP 2009235702 A * 10/2009

*Primary Examiner* — Ryan D Kwiecinski
(74) *Attorney, Agent, or Firm* — Gloria M. Steinberg, Esq.; Steinberg IP Law, LLC

(57) ABSTRACT

Disclosed is a device for supporting acoustical ceilings and other suspended objects. The device includes a clamp that is removably inserted into an outer sleeve. The exterior wall of the clamp includes threaded elements that can mate with threaded elements disposed on the interior wall of the outer sleeve so that the clamp can twist in and out of the outer sleeve in a screw-like manner. The clamp includes a cavity for securing a ceiling wire therein, wherein the ceiling wire can be attached to an overhead ceiling structure. The outer sleeve is removably secured to a ceiling grid. In use, the clamp can be repositioned within the outer sleeve to adjust the height of the ceiling grid. In this way, the present invention can be used in construction and commercial applications in a convenient manner, thereby simplifying the process of providing support for acoustic ceilings.

15 Claims, 7 Drawing Sheets

(56) References Cited

U.S. PATENT DOCUMENTS

| | | | | |
|---|---|---|---|---|
| 2012/0260548 | A1* | 10/2012 | Andrulewich | A47G 1/0605 40/743 |
| 2014/0061417 | A1* | 3/2014 | Maisch | E04B 9/205 248/327 |
| 2014/0331579 | A1* | 11/2014 | Evensen | E04B 2/90 52/204.593 |
| 2015/0113891 | A1* | 4/2015 | Evensen | E04B 2/90 52/204.7 |
| 2016/0333581 | A1* | 11/2016 | Van Dore | E04B 9/0478 |

* cited by examiner

DEVICE FOR SUPPORTING ACOUSTICAL CEILINGS

CROSS-REFERENCE TO RELATED APPLICATIONS

This application claimed the benefit of U.S. Provisional Patent Application No. 62/264,961, filed on Dec. 9, 2015, which is hereby incorporated by reference in its entirety.

FIELD OF THE INVENTION

The present invention relates generally to suspended and/or acoustical ceilings. More particularly, the present invention is directed to a device that is used to a support system for suspended and/or acoustical ceilings and other similar fixtures.

BACKGROUND OF THE INVENTION

Various types of ceiling systems are used in commercial and residential building construction to provide a desired acoustical performance and appearance. One type of common ceiling system is a suspended acoustical tile ceiling, which typically comprises some sort of a panel or grid structure suspended from the overhead structural ceiling of the room.

Traditionally, suspended ceilings grids are held by hanger wires attached to an overhead support structure. The hanger wires are threaded through an exposed tee grid on the acoustical lay-in ceiling panel and then each of the wires is tied to itself. These hanger wire systems as disclosed in the prior art have several known drawbacks, however. While existing hanger wires can support ceiling grids and ceiling panels, these wires are inconvenient to connect and tie, thus making it laborious to install acoustic ceilings. Additionally, untying and re-tying wires can damage the wires over time. Damaged wires are unlawful in many jurisdictions as they could lead to unsafe conditions. In this regard, the invention described herein addresses this problem.

SUMMARY OF THE INVENTION

In view of the disadvantages inherent in the known types of devices for supporting acoustic ceiling tiles now present in the prior art, the present invention provides an improved acoustical ceiling support device for grid systems, lighting fixtures, mechanical registers, electrical boxes, fire alarm devices, and the like.

The following discloses a simplified summary of the specification in order to provide a basic understanding of some aspects of the specification. This summary is not an extensive overview of the specification. It is intended to neither identify key or critical elements of the specification nor delineate the scope of the specification. Its sole purpose is to disclose some concepts of the specification in a simplified form as to prelude to the more detailed description that is disclosed later.

The present invention comprises a support device for acoustical ceilings and other suspended items or objects. The device comprises a clamp having a first section that is hingedly attached to a second section. Each of the first section and the second section of the clamp comprises an elongated member having a first end and a second end, wherein the distance between the first end and the second end is the length of the elongated member. Each elongated member is curved so that it is substantially half of a cylinder.

In this way, the first section and the second section form a complete cylinder with a hollow cavity when attached together.

The interior wall of the clamp comprises a plurality of spikes that is composed of a high-friction material. The clamp is configured to secure a ceiling wire therein. The exterior wall of the clamp comprises threaded elements such that the clamp can be removably inserted in an outer sleeve via a screw connection. In this regard, the interior wall of the outer sleeve comprises mating threaded elements for receiving the clamp therein. The outer sleeve further comprises a pair of extended portions that can hold a tee grid therebetween, wherein the tee grid is secured in place via a stopper. The tee grid is attached to a ceiling grid, thereby allowing the outer sleeve to support the ceiling grid when attached to the tee grid. It is noted that while the exemplary embodiment of the invention is used with acoustical ceilings, the present invention can be used to support lighting fixtures, mechanical registers, electrical boxes, fire alarm devices, and the like.

It is, therefore, an objective of the present invention to provide a device that clips onto a ceiling wire for easily installing acoustic ceiling tiles without the need for tying the wire around itself.

It is another objective of the present invention to provide a device for readily adjusting a height of acoustic ceiling tiles and leveling acoustic ceiling tiles in a convenient manner.

It is still another objective of the present invention to provide a device for installing new and existing acoustic ceiling tiles.

It is still another objective of the present invention to provide a device for installing new and existing lighting fixtures, mechanical registers, electrical boxes, fire alarm devices, and other devices that can be hung by a ceiling wire.

A final objective of the present invention to provide a device that may be readily fabricated from materials that permit relative economy and commensurate with durability.

In the light of the foregoing, these and other objects are accomplished in accordance with the principles of the present invention, wherein the novelty of the present invention will become apparent from the following detailed description and appended claims.

BRIEF DESCRIPTION OF THE DRAWINGS

The above and other objects and advantages of the present invention will be apparent upon consideration of the following detailed description, taken in conjunction with the accompanying exemplary drawings, in which like reference characters refer to like parts throughout, and in which.

DETAILED DESCRIPTION OF THE INVENTION

The present invention is directed towards a device for supporting acoustical or dropped ceilings and other suspended fixtures. For purposes of clarity, and not by way of limitation, illustrative views of the present invention are described with references made to the above-identified figures. Various modifications obvious to one skilled in the art are deemed to be within the spirit and scope of the present invention. In this regard, while the exemplary embodiment of the invention is used with acoustical ceilings, the present invention can be used to support lighting fixtures, mechanical registers, electrical boxes, fire alarm devices, and the like.

As used herein, the word "exemplary" means serving as an example, instance, or illustration. Any aspect or design described herein as "exemplary" is not necessarily to be construed as preferred or advantageous over other aspects or designs. Rather, use of the word exemplary is intended to disclose concepts in a concrete fashion. As used in this application, the term "or" is intended to mean an inclusive "or" rather than an exclusive "or." Additionally, the articles "a" and "an" as used in this application and the appended claims should generally be construed to mean "one or more" or "at least one" unless specified otherwise or clear from context to be directed to a singular form. It is to be appreciated that determinations or inferences referenced throughout the subject specification can be practiced through the use of artificial intelligence techniques.

Figure 1:
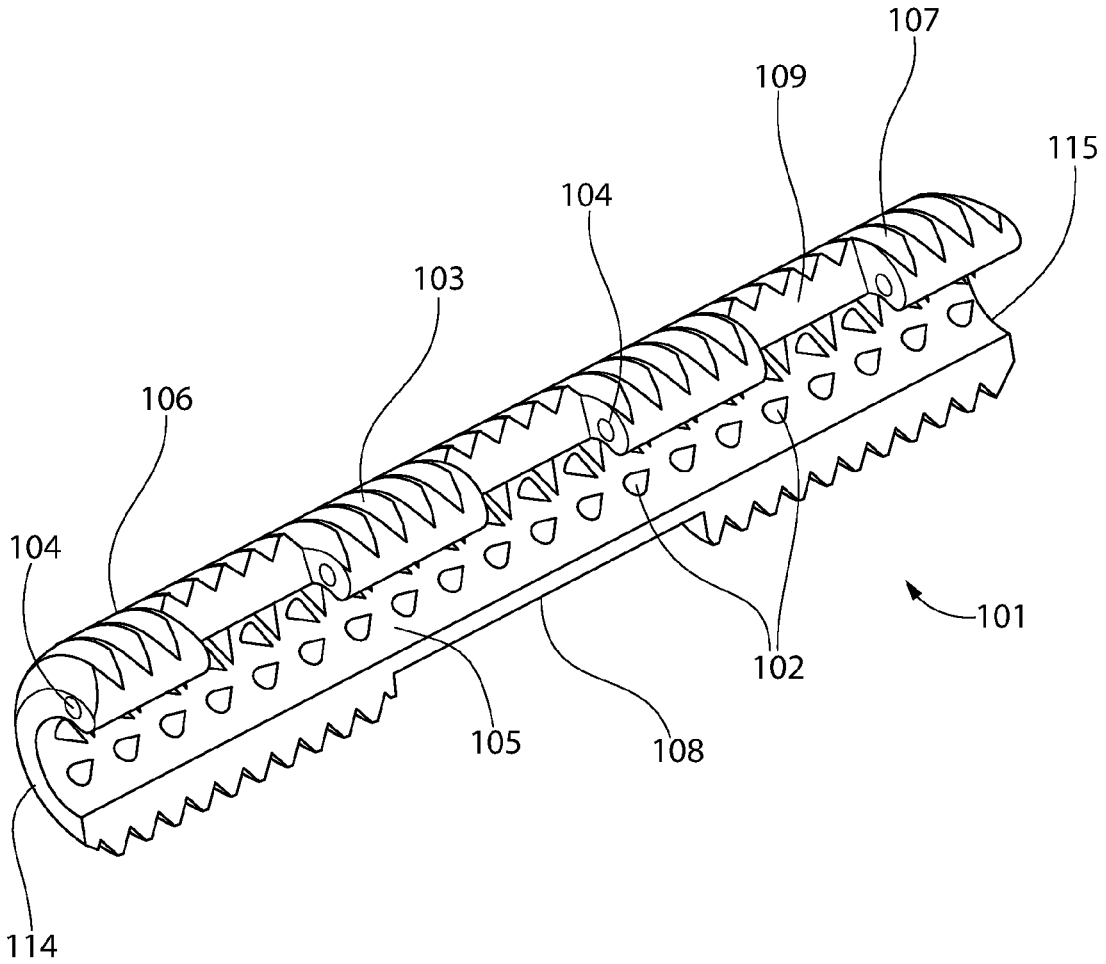
FIG. 1 shows a first section of the clamp of the present invention.
Figure 2:
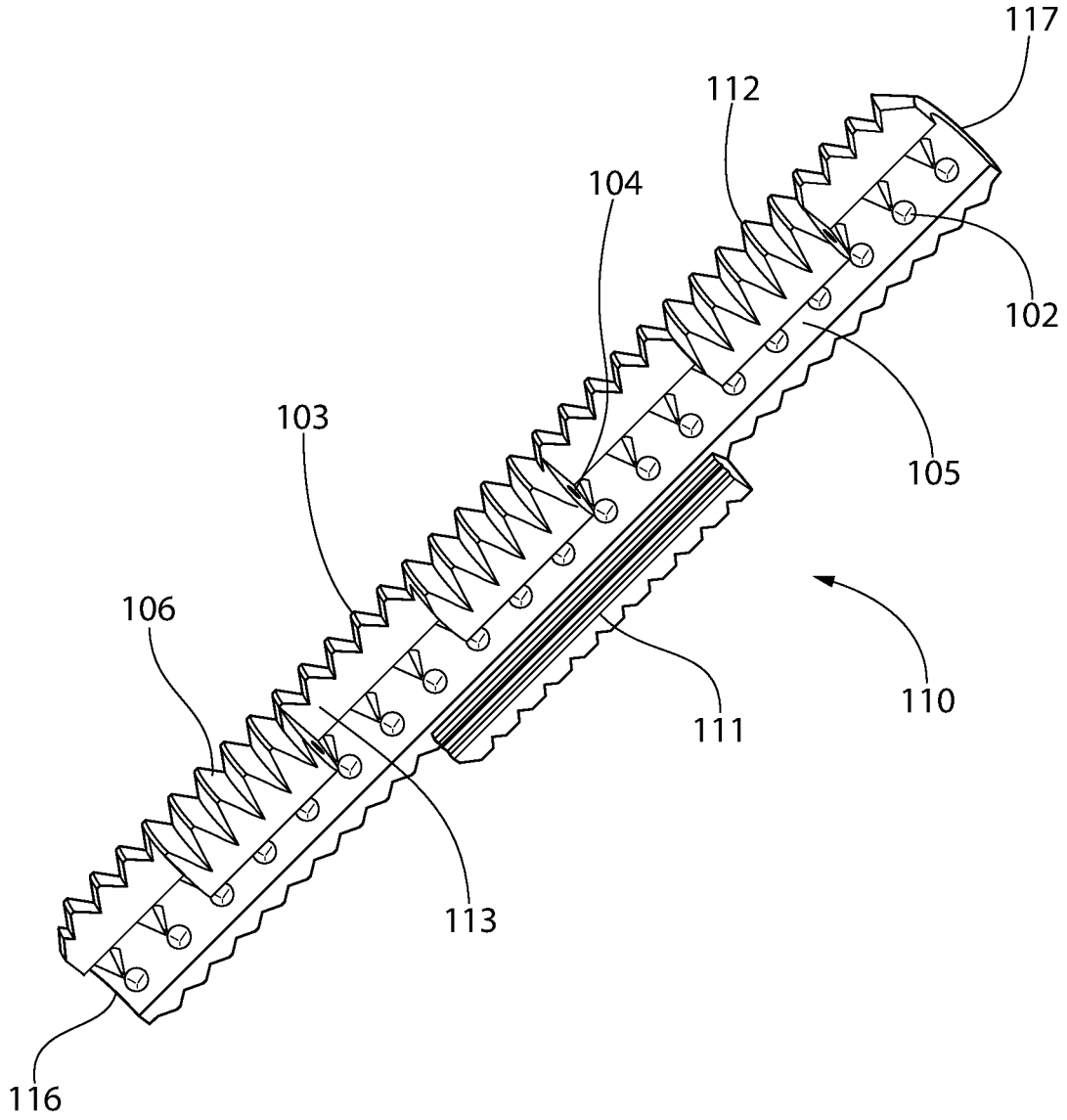
FIG. 2 shows a second section of the clamp of the present invention.

Referring now to FIGS. 1 and 2, there are shown views of a first section and a second section of a clamp of the present invention. Each of the first section 101 and the second section 110 comprises an elongated body comprising an exterior wall 106 and an interior wall 105, wherein the exterior wall 106 comprises a ridged surface 103 or a threaded element and the interior wall 105 comprises a plurality of spikes 102 separated at regular intervals.

The spikes 102 comprise a substantially conical shape and extend inward such that the tips of the spikes 102 are biased away from the interior wall 105. The spikes 102 are shaped and dimensioned so that they do not overlap one another. Additionally, the spikes 102 are disposed so as to leave room for a ceiling wire to extend through the interior of the clamp when the first section 101 and the second section 110 are joined together. Additionally, the spikes 102 are composed of a high-friction material such that the ceiling wire would not easily slide through the clamp and the ceiling wire can be secured via high-friction means.

The first section 101 and the second section 110 has a first side edge opposite a second side edge, the two side edges separated by a space. Thus, each of the first section 101 and the second section 110 is a half of a cylinder such that a cross section of both of the sections 101, 110 is substantially C-shaped. In this way, when the first section 101 and the second section 110 of the clamp are joined together, a cross section of the clamp is substantially circular. In the illustrated embodiment, the first section 101 and the second section 110 can be joined together via a pin so as to resemble a cylinder or a tube structure with a hollow interior portion.

More particularly, the first side edge of the first section 101 comprises a first set of joining sections 107, wherein each of the joining sections 107 is separated by a first set of spaces 109. Each of the joining sections 107 includes an opening 104 that spans the width of the joining section 107 on which it is disposed such that each end of the opening 104 leads to the spaces 109 between the joining sections 107. Similarly, the first side edge of the second section 110 comprises a second set of joining sections 112, wherein each of the joining sections 112 is separated by a second set of spaces 113. Each of the joining sections 112 includes an opening 104 that spans the width of the joining section 112 on which it is disposed such that each end of the opening 104 leads to the spaces 113 between the joining sections 112. The second side edge of the first section 101 includes an elongated space 108. The elongated space 108 is centrally located along the second side edge of the first section 101. The elongated space 108 is shaped and dimensioned to receive an elongated joining section 111 on the second side edge of the second section 110. The elongated joining section 111 is centrally located along the second side edge of the second section 110.

The first set of the joining sections 107 is configured to mate with the second set of spaces 113, and the second set of the joining sections 112 is configured to mate with the first set of spaces 109 such that the openings 104 on the first and second sections 101, 110 are coaxially aligned to receive a pin 143 (FIG. 4) therethrough. In this way, the first section 101 can be hingedly attached to the second section 110 of the clamp, and the clamp can be moved from an open position to a closed position.

The distance between the first end 114 and the second end 115 of the elongated body define a length of the first section 101, and the distance between the first end 116 and the second end 117 of the elongated body define a length of the second section 110. The length of the first section 101 and the length of the second section 110 are substantially equal so that the two sections 101, 110 can be joined together to form a unitary tubular structure.

Figure 3:
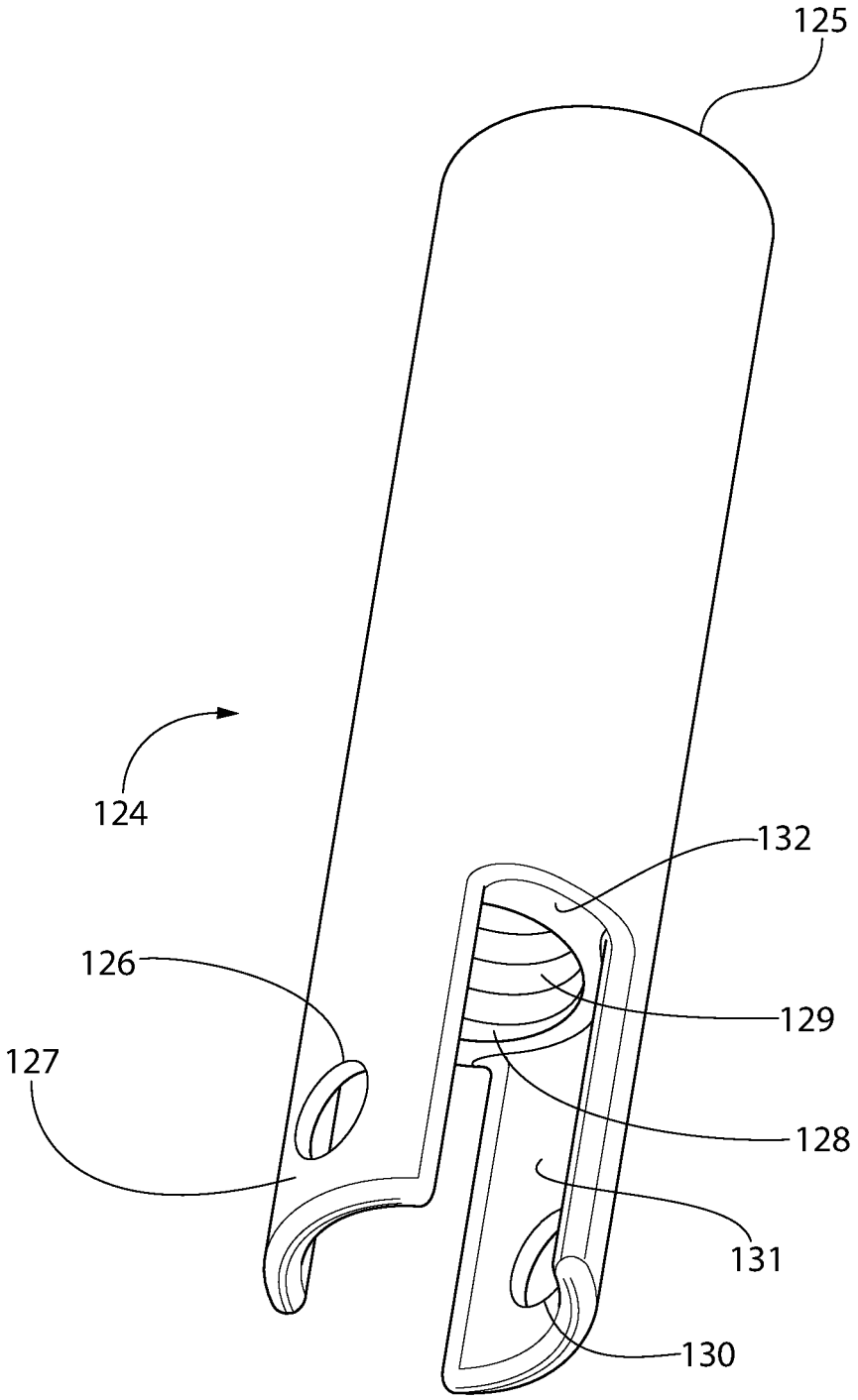
FIG. 3 shows an outer sleeve of the present invention.

Referring now to FIG. 3, there is shown a perspective view of an outer sleeve of the present invention. The outer sleeve 124 includes a substantially cylindrical body with a first end 125 and a second end 132. The interior surface 128 of the cylindrical body includes threaded elements 129 thereon, wherein the threaded elements 129 can mate with the threaded elements 103 (FIGS. 1, 2) on the exterior wall 106 (FIGS. 1, 2) of the first 101 (FIG. 1) and second sections 110 (FIG. 2) of the clamp. The second end 132 of the cylindrical body includes a pair of extended portions comprising a first extended portion 127 and a second extended portion 131 extending downward, the two portions 127, 131 separated by space and positioned opposite to each other. Each of the first extended portion 127 and the second extended portion 131 comprises a circular opening 126, 130 thereon. The openings 126, 130 on the first and second extended portions 127, 131 are aligned. In this way, the openings 126, 130 are configured to receive a stopper or a pin therethrough for securing the device onto a ceiling grid.

Figure 4:
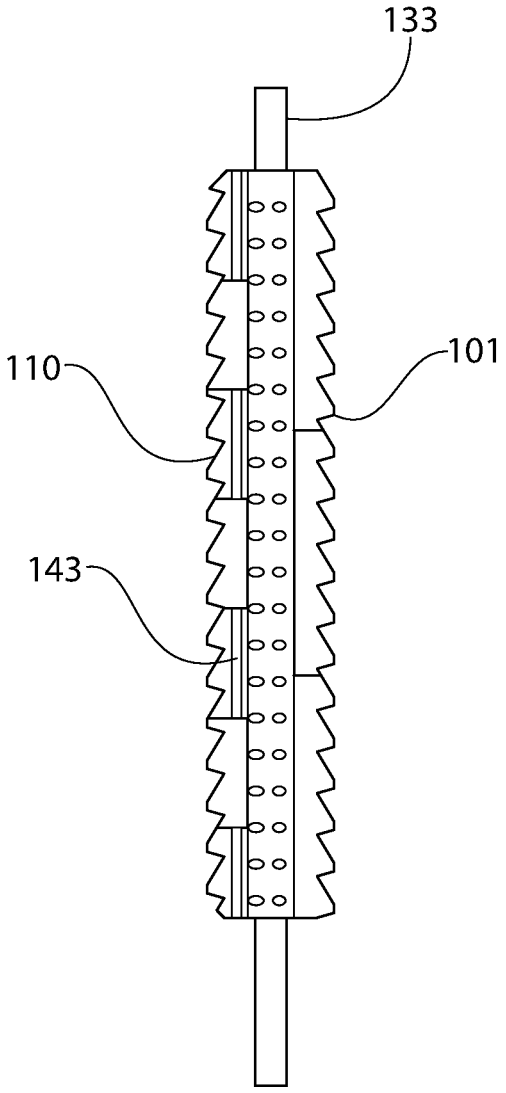
FIG. 4 shows a view of a ceiling wire as disposed within the clamp of the present invention.

Referring now to FIG. 4, there is shown a view of the clamp as attached to a ceiling wire. The first section 101 and the second section 110 of the clamp are joined together via a pin 143 that is disposed through the opening on the first and second section 101, 110. The clamp is configured to hold a portion of a ceiling wire 133 therein. The ceiling wire 133 can be placed between the first section 101 and the second section 110 when the clamp is in an open position and then secured when the clamp is in a closed position, as shown. The spikes 102 (FIGS. 1, 2) prevent the ceiling wire 133 from sliding within the clamp.

Figure 5:
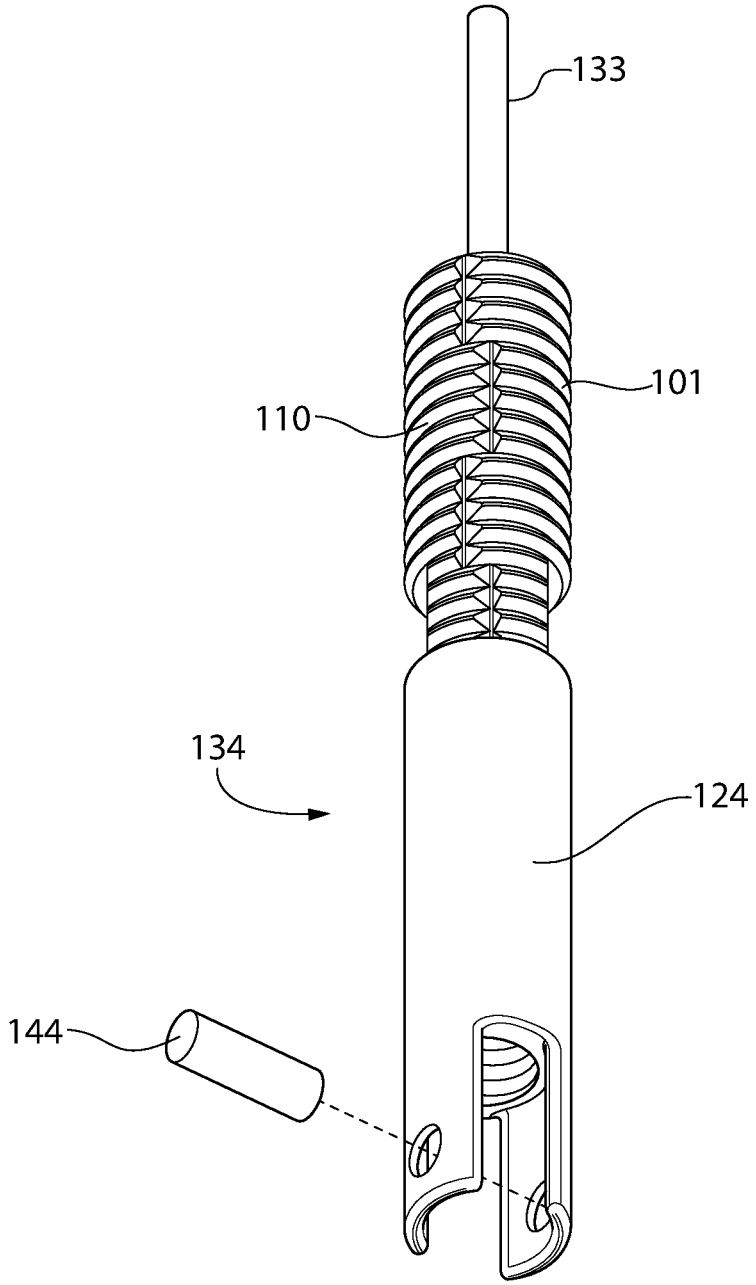
FIG. 5 shows a perspective view of the present invention as assembled.
Figure 6:
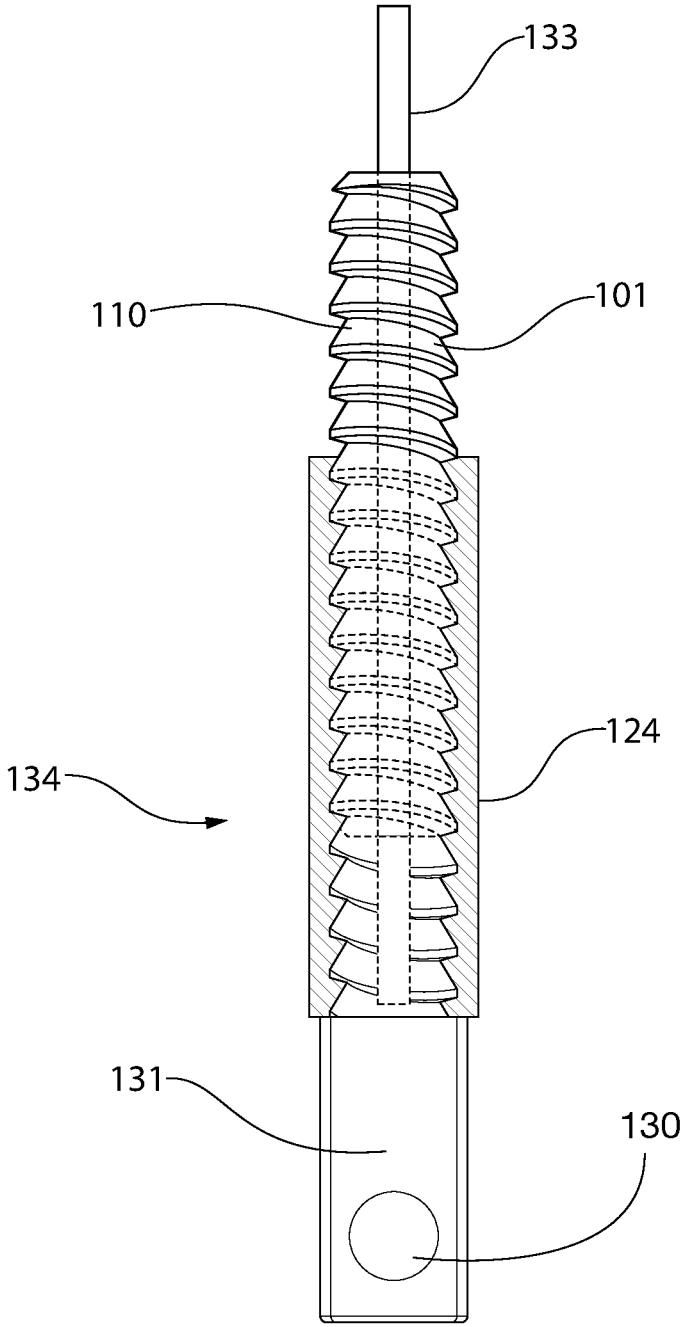
FIG. 6 shows a cross-sectional view of the present invention as assembled.

Referring now to FIGS. 5 and 6, there are shown views of the present invention as assembled. The clamp is inserted into the outer sleeve 124 in a screw-like manner (i.e., in a twisting or rotating motion) via threaded elements on the exterior wall of the first section 101 and second section 110 of the clamp and mating threaded elements on the interior surface of the outer sleeve 124. Preferably, the ceiling wire 133 is inserted into the clamp before the clamp is inserted into the outer sleeve 124. It is contemplated that the upper end of the ceiling wire 133 is attached to an overhead structure or ceiling structure.

The device 134 can be connected to a ceiling grid by placing an exposed tee grid of the ceiling grid between the two extended portions and aligning the openings 130 on the extended portion 131 of the outer sleeve 124 to an aperture on the exposed tee grid of the ceiling grid. Thereafter, the ceiling grid can be secured in place by placing a stopper 144 through the opening on the first extended portion of the outer sleeve 124, the aperture on the exposed tee grid, and the opening 130 on the second extended portion of the outer sleeve 124.

Figure 7:
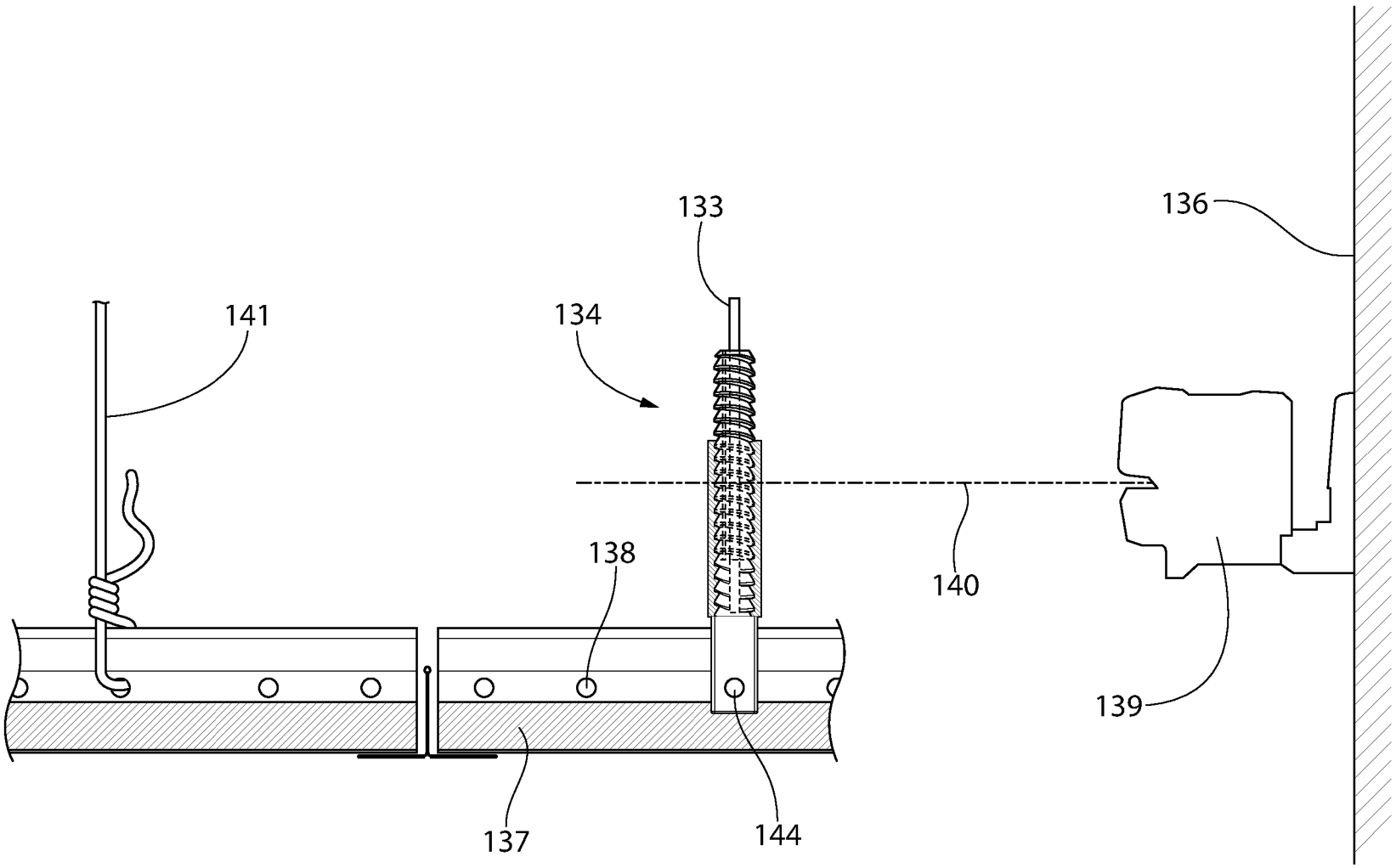
FIG. 7 shows a view of the present invention in use and as compared to prior art.

Referring now to FIG. 7, there is shown a view of the present invention in use. In operation, the desired location and/or position for the suspended ceiling are determined (i.e., by considering the lighting location, room scale, etc.) and the wall angles are attached. Thereafter, suspension or ceiling wires are attached. It is contemplated that various types of ceiling wires 133 can be used, including 12 gauge ceiling wires.

The ceiling wire 133 can be inserted into the clamp of the device 134, and then the clamp can be inserted into the outer sleeve. The outer sleeve secures the tee grid between its first and second extended portions on a lower end thereof so as to align an aperture 138 with the openings on the extended portions and insert the stopper 144 therethrough. The stopper 144 can be secured via press-fit or similar means. The existing method of securing the ceiling wire 133 to the ceiling grid 137 would entail looping a standalone ceiling wire 141 directly through an aperture 138 on a tee grid of a ceiling grid, then tie the wire 141 around itself. Thus, if the wire 141 is not tied correctly, the ceiling grid 137 cannot be supported in a proper manner.

The tee grid is attached to a ceiling grid 137. Once a desired height or position of the suspended ceiling grid 137 is located, a laser level 139 can be mounted to a wall 136 to project a laser beam 140 to level or adjust the ceiling grids 137. In this regard, the clamp can be twisted further into the outer sleeve to shorten the length of the ceiling wire 133, thereby increasing or raising the height of the ceiling grid 137. Conversely, the clamp can be twisted further out of the outer sleeve to increase the length of the ceiling wire 133, thereby decreasing or lowering the height of the ceiling grid 137. The existing method of adjusting the height of the ceiling grid 137 would entail untying the wire 141, and either tightening or loosening the wire and then retying the wire 141. The existing method is more time consuming and inconvenient as it can be difficult to untie the ceiling wire 141 and re-tie it in place.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A device for supporting an acoustical ceiling, comprising:

a cylindrical outer sleeve removably attached to a ceiling grid; and a clamp that is removably inserted into an upper end of said outer sleeve, wherein said clamp is configured to hold a ceiling wire therein in place, further wherein said clamp comprises a first section that is hingedly attached to a second section.

2. The device of claim 1, wherein an exterior surface of said clamp and an interior surface of said outer sleeve comprise threaded elements thereon such that said clamp can screw in and out of said outer sleeve.

3. The device of claim 1, wherein an interior surface of said clamp comprises a plurality of spikes extending inward, further wherein said plurality of spikes is configured to hold said ceiling wire in place.

4. The device of claim 1, wherein said outer sleeve comprises a first end and a second end;

said second end comprising a first extended portion opposite a second extended portion;

each of said first extended portion and said second extended portion comprising an opening such that said opening of said first extended portion and said opening of said second extended portion are aligned.

5. The device of claim 4, further comprising a stopper that is configured to be inserted through said opening of said first extended portion and said opening of said second extended portion.

6. The device of claim 4, wherein said opening of said first extended portion and said opening of said second extended portion can be aligned with an aperture of a tee grid of said ceiling grid to receive said pin therethrough, thereby removably attaching said outer sleeve to said ceiling grid.

7. The device of claim 1, wherein said clamp can change in position within said outer sleeve.

8. A method of installing an acoustical ceiling, comprising the steps of:

(a) securing a ceiling wire within an interior wall of a cylindrical clamp via a plurality of spikes, wherein said cylindrical clamp can be opened to insert said ceiling wire therein and closed to secure said ceiling wire in place;

(b) inserting said clamp into an outer sleeve in a screw-like manner;

(c) attaching said outer sleeve to a ceiling grid; and (d) adjusting a height of said ceiling grid by twisting said clamp within said outer sleeve.

9. The method of claim 8, wherein step (c) further comprises the steps of:

positioning a tee grid attached to said ceiling grid at a lower end of said outer sleeve, wherein said lower end of said outer sleeve comprises a first extended portion and a second extended portion, each of said first extended portion and said second extended portion having an opening;

aligning an aperture on said tee grid between said opening on said first extended portion and said second extended portion; and securing a stopper through said aperture on said tee grid and said opening on said first extended portion and said second extended portion.

10. The method of step 9, wherein step (d) further comprises the steps of twisting said clamp out of said outer sleeve to lengthen said ceiling wire, thereby lowering said height of said ceiling grid.

11. The method of step 9, wherein step (d) further comprises the steps of twisting said clamp into said outer sleeve to shorten said ceiling wire, thereby raising said height of said ceiling grid.

12. A device for supporting an acoustical ceiling, comprising:

a cylindrical outer sleeve having an upper end and a lower end, wherein said lower end of said outer sleeve is removably attached to a ceiling grid;

a clamp comprising a first section and a second section joined together to substantially form a cylinder that is removably inserted into said upper end of said outer sleeve;

a plurality of conical spikes disposed on an interior wall of said clamp, wherein said plurality of spikes is configured to hold a ceiling wire therein.

13. The device of claim 12, further comprising:

a first set of joining sections on said first section, wherein said first set of joining sections is separated by a first set of spaces, each of said first set of joining sections comprising an opening that spans a width thereof;

a second set of joining sections on said second section, wherein said second set of joining sections is separated by a second set of spaces, each of said second set of joining sections comprising an opening that spans a width thereof;

said first set of joining sections configured to mate with said second set of spaces;

said second set of joining sections configured to mate with said first set of spaces;

a pin extending through said opening of said first section and said opening of said second section such that said first section is hingedly attached to said second section.

14. The device of claim 12, further comprising:

a first set of threaded elements on an interior surface of said outer sleeve;

a second set of threaded elements on an exterior wall of each of said first section and said section of said clamp;

said first set of threaded elements and said second set of threaded elements configured to mate to allow said clamp to twist in and out of said outer sleeve to increase a length of said ceiling wire without moving said ceiling wire within said clamp.

15. The device of claim 12, further comprising:

a pair of extended portions separated by a space to receive an exposed tee grid of a ceiling grid;

said pair of extended portions comprising openings that are aligned to receive a stopper therethrough for securing said ceiling grid in place.

* * * * *